United States Patent [19]

Clarke

[11] Patent Number: 4,619,616

[45] Date of Patent: Oct. 28, 1986

[54] WEAPON AIM-TRAINING APPARATUS

[75] Inventor: John J. Clarke, Cheadle Hulme, England

[73] Assignee: Ferranti plc, Cheshire, England

[21] Appl. No.: 743,900

[22] Filed: Jun. 12, 1985

[30] Foreign Application Priority Data

Jun. 14, 1984 [GB] United Kingdom ..... 8415148

[51] Int. Cl.[4] ..... F41G 3/26

[52] U.S. Cl. ..... 434/22; 434/19; 273/310

[58] Field of Search ..... 434/19–22; 273/310

[56] References Cited

U.S. PATENT DOCUMENTS

| | | | |
|---|---|---|---|
| 4,065,860 | 1/1978 | Linton et al. | 273/310 |
| 4,175,748 | 11/1979 | Yokoi | 273/310 |
| 4,395,045 | 7/1983 | Baer | 273/312 |

*Primary Examiner*—Leo P. Picard

*Attorney, Agent, or Firm*—Kerkam, Stowell, Kondracki & Clarke

[57] ABSTRACT

Optical aim-training apparatus 10 (FIG. 1) for a rifle 20, or the like comprises a CRT displaying a target image on a scanned line raster. The rifle is simulated and has photo-detection device 21 contained in a housing 22 located adjacent the barrel 19. The photodetection device has a detection axis 23, aligned parallel with the rifle bore axis, which 23 intersects the screen at detection point 34. The rifle sighting device has a sightline also parallel to the bore axis and detection axis intersecting the screen at aim point 33. The offset between aim and detection points is determined by a calibration procedure and when aim is taken at a target image and the trigger depressed a marker region of raster 29, displaced from the image by the calibration offset, is brightened temporarily. A series of light pulses due to scanning of the marker region raster is detected and the screen location of the center of the detector field of view i.e. detection point 34, found. With said calibration offset this enables the actual aim point to be found without masking the target image screen brightening necessary to enable photodetection. A further detection point (FIG. 5) may be defined and the relationship between the two detection points used to monitor the orientation of the rifle about the bore axis and its distance from the screen.

21 Claims, 8 Drawing Figures

Figure 1:
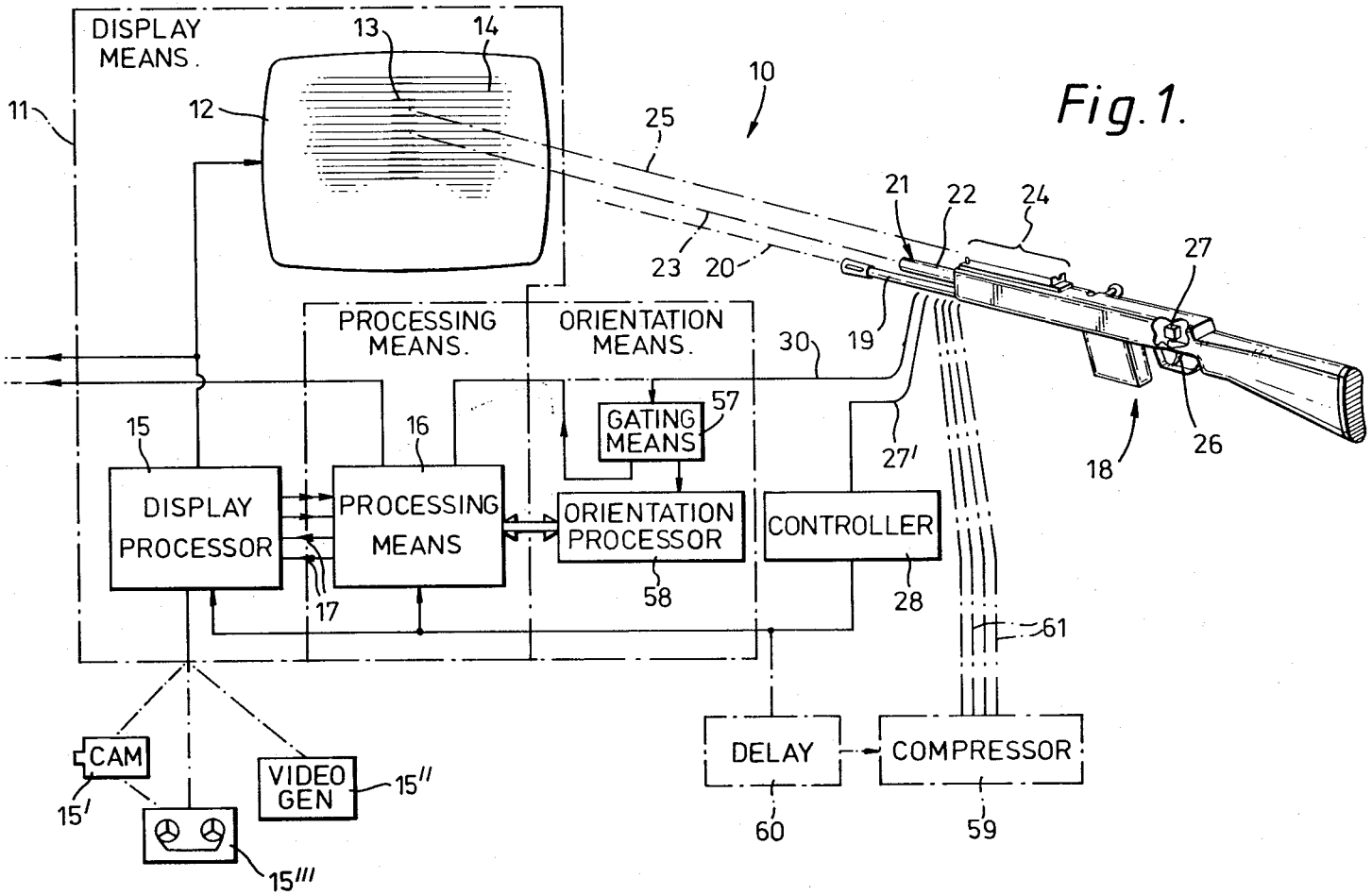

DISPLAY MEANS.
PROCESSING MEANS.
ORIENTATION MEANS.
GATING MEANS
ORIENTATION PROCESSOR
PROCESSING MEANS
DISPLAY PROCESSOR
CONTROLLER
DELAY
COMPRESSOR
VIDEO GEN
CAM
10
11
12
13
14
15
15'
15''
15'''
16
17
18
19
20
21
22
23
24
25
26
27
27'
28
30
57
58
59
60
61

WEAPON AIM-TRAINING APPARATUS

This invention relates to weapon aim-training apparatus, particularly for a weapon of the type which fires a projectile at a target in a substantially straight-line trajectory, such as a hand-held firearm.

The target is intended to be represented by an image shown on the screen of display means, such as cathode ray tube or similar device, so that the weapon is not able to fire a projectile, but may nevertheless comprise a real weapon suitably modified to effect aim-training or may be a simulated weapon.

It is known to provide optical aim-training apparatus for hand-held firearms such as rifles or pistols which are based upon the transmission and detection of optical radiation, usually visible light, between a simulated weapon and a target or vicinity of a target.

These may be further categorised into those in which the weapon contains a light source, often a laser triggered by "firing" the weapon to emit a pulse of light towards a detector bearing a known relationship with a target, those in which light transmitter and receiver are located with the target and the weapon carries a reflector which reflects the beam along the correct path when the weapon is suitably aligned, and those in which the target comprises a light source and the weapon carries a detector of that light.

The present invention is concerned with optical aim training apparatus of this latter category.

One such apparatus is described in U.S. Pat. No. 4,395,045 as a television game in which a simulated rifle contains photodetection means coaxially aligned with the barrel bore axis. With the rifle pointed at a television screen upon which a target image is normally displayed by raster scanning, operation of a rifle trigger actuates a momentary unblanking of the television raster resulting in a flash of light from the brightened screen. This is visible to the operative as a continuous brightening of the screen and to the photo-detection means as a series of pulses corresponding to individual raster lines.

The field of view of the detection means encompasses several such raster lines and from relationships between the raster generation signals and the times of occurrence of the detected pulses the position of the centre of the field of view, corresponding to the place where the rifle was pointing, is stated to be found.

The accuracy with which position which be determined is adequate for a game but not for the serious marksmanship training of weapon operatives. Similarly, the masking of the target caused by the necessity to flash the whole raster area is considered unrealistic and distracting to the trainee.

It is an object of the present invention to provide for a weapon of the projectile-firing type optical aim-training apparatus which is more accurate than, and mitigates disadvantages of, known systems.

According to the present invention weapon optical aim-training apparatus for a projectile firing type of weapon comprises (i) display means, including a screen, arranged to display an image of a target, (ii) a weapon arranged to be directed at the screen and displaced therefrom at an operating position, said weapon including (a) sighting means defining a sight-line axis which extends to, and intersects, the screen to define an aim point, (b) photo-detection means having a field of view centred on a detection axis which extends to, and intersects, the screen at a detection point such that the detection point is displaced from the aim point in a known relationship, and (c) switching means operatively connected to a trigger of the weapon, (iii) control means responsive to operation of the switching means by actuation of the trigger to cause said display means to define on the screen, by the emission of optical radiation from a plurality of display element locations as a raster of lines of successively illuminated display element locations, a marker region smaller than the screen, but larger than the field of view of the photo-detection means, and displaced from the target image by said known relationship, and (iv) processing means responsive to the detection by the photo-detection means of optical radiation from said marker region of the screen to determine the position of the detection point with respect to the raster and thus the position of the aim point with respect to the position of the target image.

In addition to training an operative to aim a weapon correctly it is also desirable to ensure correct holding of the weapon, in particular correct orientation of the weapon about a bore axis thereof, in order to identify sources of aim error and the apparatus defined in the preceding paragraph may include orientation means operable to determine the orientation of the weapon about the bore axis.

Figure 2A:
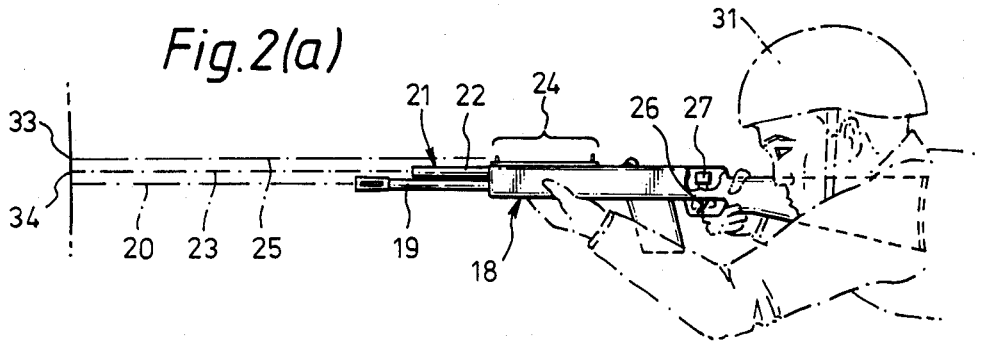
Figure 2B:
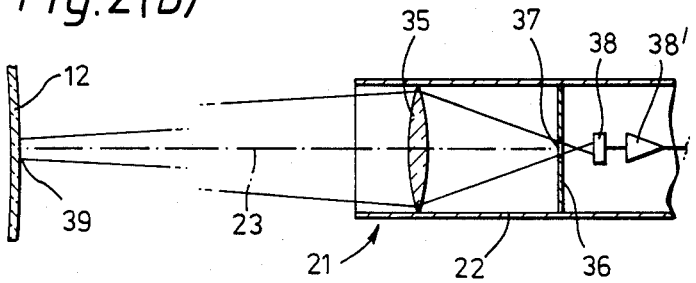
Figure 3:
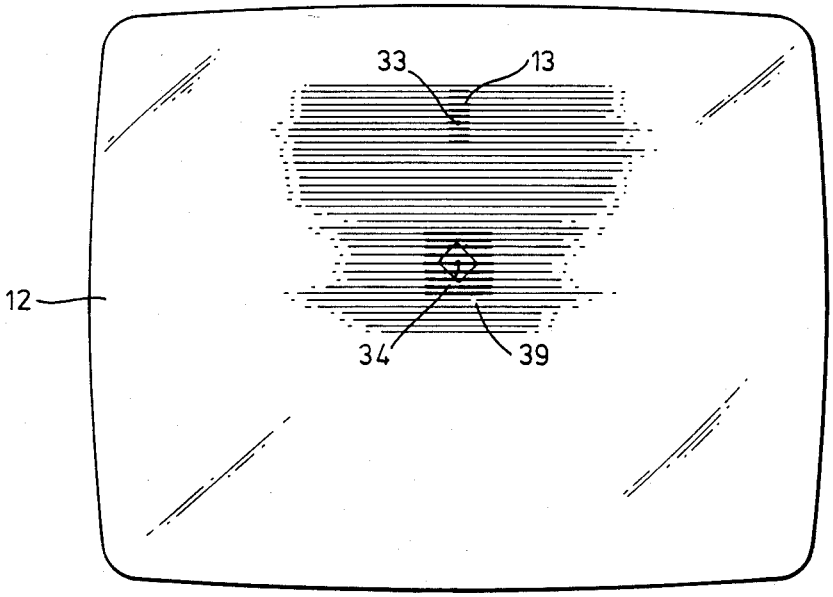
Figure 4A:
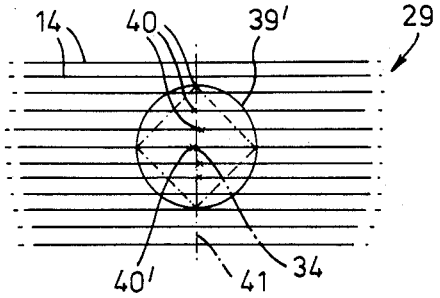
Figure 4B:
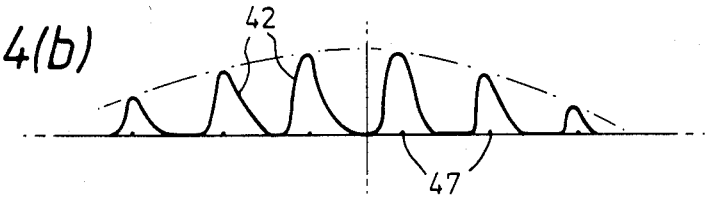
Figure 5A:
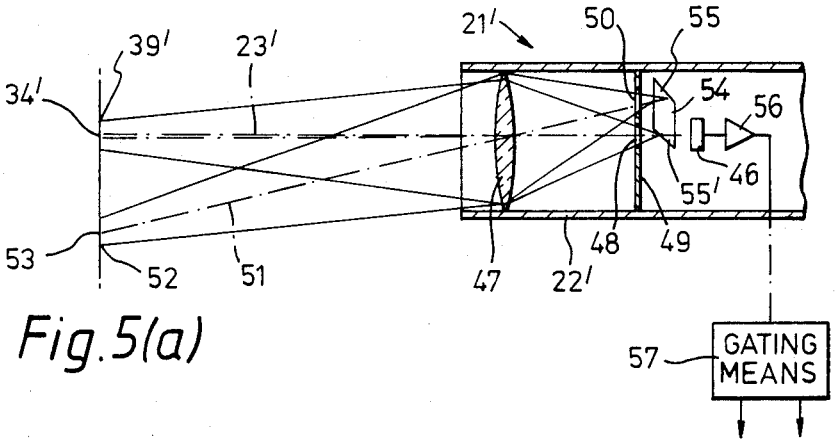
Figure 5B:
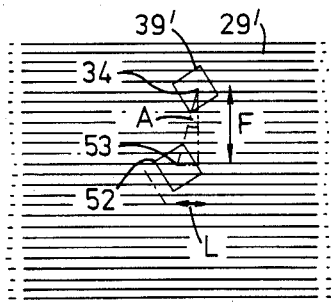

An embodiment of the weapon will now be described by way of example with reference to the accompanying drawings, in which:

FIG. 1 is a schematic view of the optical aim-training apparatus according to the present invention showing a 'weapon' in the form of a simulated rifle, including photo-detection means, and a television CRT screen displaying an image of a target, FIG. 2(*a*) is a sectional elevation of the arrangement of FIG. 1 along the bore axis showing the relationships between distances and axes in the arrangement, FIG. 2(*b*) is a sectional elevation through the photo-detection means, of FIG. 2(*a*), FIG. 3 is a schematic view of a portion of the CRT screen showing the formation of images thereon and relationship the between it and a diamond-shaped field of view of the photo-detection means and a detection point defined thereby, FIG. 4(*a*) shows schematically the region of screen in the vicinity of a circular field of view of the photo-detection means to illustrate one process of accurate determination of the detection point along one axis of the raster, FIG. 4(*b*) illustrates a process of accurately determining the detection point of the field of view shown in FIG. 4(*a*) along the other axis of the raster, FIG. 5(*a*) shows a sectional elevation through a portion of a rifle barrel containing a modified form of photo-detection means, including a further detection axis, by which rifle orientation and sitance from the screen may be monitored, and FIG. 5(*b*) is a schematic representation of the screen in a region of the fields of view of both detection axes illustrative of the determination of rifle orientation.

Referring to FIG. 1 optical aim-training apparatus 10 comprises display means 11 including a CRT having a screen 12 on which an image 13 of a target is displayed on a darkened grey background by means of a scanned raster of substantially parallel horizontal lines 14 in the manner of a conventional television display format. The raster frame may consist of a single or interlaced field but for convenience of description it will be assumed that a single scanned field constitutes one frame.

The display means includes a display processor 15 which comprises the conventional circuitry necessary to provide line (horizontal) and field (vertical) sync. pulses to control the scanning of the electron beam within the CRT, and thus the light spot formed on the screen, as a raster and the modulation signals to the scanning electron beam to vary the spot intensity and form the image. Such sync. pulses may also be referred to as raster control signals. The video signals representing the image may form still or moving pictures generated by camera equipment 15' or generated electronically by generator 15'' and may be generated and displayed in real time or stored and read from external storage means 15'' or from storage means (not shown) in the display processor 15.

The display processor also provides timing signals associated with the line and field sync. pulses and the position within the field of a target image to processing means 16 on lines 17.

The weapon 18 on which aim is to be practised comprises a simulated rifle. The rifle is in fact a real weapon in order to give realism of feel to the trainee but is modified so as to be incapable of firing a projectile. The rifle barrel 19 defines a bore axis 20. Mounted adjacent the muzzle end of the barrel is photo-detection means 21 comprising a housing 22 aligned therewith, in which is contained optical and optoelectronic elements, having a field of view centred on a detection axis 23 extending parallel to the bore axis 20.

The rifle includes conventional sighting means 24 and provides a sight-line axis 25 which extends parallel to, and lies in the same vertical plane as, the bore and detection axes when the rifle is correctly orientated about the bore-axis.

The rifle is also modified in that the trigger 26 actuates switching means 27 and provides a trigger signal, indicative of operation of the trigger, on line 27' to control means 28.

The control means, in response to the trigger signal, provides signals to the display processor 15 and causes a temporary brightening of a predetermined small portion 29 of the television raster which is displaced from the target image 13 and comprises a marker region.

The photo-detection means 21 responds to optical radiation from this brightly illuminated marker region and provides detection signals on line 30 to the processing means 16.

The positional relationships between CRT screen and weapon, between sight line and detection axes and between target image and marker region, together with the principle of operation, will be more readily appreciated with reference to FIGS. 2 and 3.

Referring now to FIG. 2 this shows rifle 18 held by a trainee 31 with the bore axis 20 substantially horizontal and correctly orientated about that axis with the sight-line 25 displaced vertically above it. The sighting means 24 is adjusted with said bore axis and sight line parallel for shooting at a target disposed at some hundreds of meters distant. A target at such a range might be presented by a crouching figure of the order of one meter high.

The rifle is in fact disposed at an operating position of the order of one metre from the CRT screen 12 of the display means and the target image 13 thereon is of the order of one centimetre high giving an appropriately scaled presentation to the trainee marksman.

It will be appreciated that with this configuration, at the operating distance of the weapon from the screen the sightline 25 and detection axis 23 are displaced vertically, the intersection between the sight line 25 and the screen defining an aim point 33 and the intersection of the detection axis 23 with the screen defining a detection point 34.

FIG. 3 shows in enlarged form a part of the screen having superimposed thereon the scanned raster pattern from which the image 13 and marker region 29 are derived and showing the aim point 33 and detection point 34.

FIG. 2(*b*) shows a sectional elevation through the photo-detection means 21. The housing 22 is cylindrical containing a focussing lens 35 and aperture plate 36 containing a small aperture 37 behind, and adjacent to, which is a semiconductor photo-detector 38. The photodetector 38 produces an electrical output signal at a level corresponding to the level of illumination which signal is applied to signal amplifier 38'. The aperture 37 comprises a diamond shape having a side length of some 0.2 mm. and the focal length of the lend, and the ratio of aperture-lens separation to lens-screen separation chosen such that the aperture defines a correspondingly shaped field of view 39 at the screen less than 0.5 cm. across, encompassing several raster lines.

It will be appreciated from FIG. 3 that when a brightened raster is generated on the region of the screen which intersects the field of view 39 the photo-detection means receives a series of light 'pulses' corresponding to the scanning of successive lines of the raster. These light pulses differ in amplitude and intensity as a function of the one length intersecting the field of view . The photo-detection means produces from each an electrical detection pulse, also characteristic of the line length intersecting the field of view, enabling the processing means 16 to determine from the corresponding succession of detectin pulses the detection point 34 in terms of the raster parameters, that is, line number and position along the line (display element location).

The photodetector 38 provides the light induced signals to an amplifier 38' which has a relatively slow rise time in response to input signals, said rise time being chosen to be not less than the maximum time in any scanned line of the marker region that optical radiation can be received by the photodetector, in order to produce detection signals for each line which reach a peak value after the scanning spot has crossed the field of view.

It has been found that the pulse-like detection signal produced by such a photodetection arrangement has a peak value, or amplitude, related to the length of the line, section intersecting the field of view, the peak value occurring a constant time after the scanning spot has crossed the mid-point of the line section.

Thus it is possible to determine by the occurrence of each detection signal peak for each line, the mid-point of the intersection of that line with the field of view in terms of line scan time or line display element location and by determining which detection signal has the largest peak value, to determine the longest raster line section and thus the mid-point of the field of view, i.e. detection point 34.

The detection signals are applied to the processing means 16 wherein peak detection means determines the occurrence and absolute or relative peak values and calculation means applies known signal processing techniques with respect to line and field sync. signals received in lines 17 to determine said line number and line position of the detection point.

The apparatus is set up initially in a calibration procedure with the rifle supported at the operating position such that a position of the aim point on the screen is determined by optical methods.

The screen is brightened over the whole raster area and the screen position of the detection point is determined by the processing means using the above described procedure, the processing means being also arranged to determine the displacement relationship between the detection and aim point in terms of the raster line and field scan displacements. This measured separation becomes a 'known' displacement for subsequent operation of the apparatus with the weapon located substantially at the operating position. With the vertically disposed relationship discribed between sight line and detection axis, the known displacement between aim point and detection point is a vertical one.

Following this calibration procedure an image 13 may be formed anywhere in a large part of the scanned area and the predetermined marker region 29, which need be larger than the field of view only by the amount of tolerance permitted on the aim point, is produced by temporarily brightening this known displacement below it.

It will be appreciated that the precise displacement of the marker region from the image need only be approximate, depending on its dimensions, but preferably it is arranged to be defined with the centre thereof said known displacement from a nominal target aim point.

Considering operation, the screen area is scanned by the electron beam with the pattern of raster 14, the electron beam, and the spot it produces, being suppressed in intensity to give a uniform grey area or completely 'blanked' to give an unilluminated or black area. The target image 13 is displayed by brightening of the normally suppressed scanning spot by the video signals representing the image, the positions of the display of suitable target features being applied to the processing means 16 and stored as a function of their disposition in the raster, that is, line number and scan position on line.

When the trainee has aimed the weapon at the target image and squeezed the trigger the predetermined portion 29 of the raster forming the marker region is brightened or unblanked temporarily below the image at the known displacement determined from the calibration procedure.

The photo-detection means, by virtue of a field of view 39 extending across a plurality of raster lines, receives a succession of optical pulses due to scanning of each line and for each pulse generates a detection signal applied to the processing means.

The processing means 16 processes the signals as described above for the calibration procedure and determines from the signal having the maximum amplitude, its line position and the line number on which it occurs. The detection point thereby defined is related to its known displacement from the aim point to establish corresponding raster coordinates for the actual aim point.

This may be simply shown to the trainee as a marker overlaying or superimposed upon the image or in terms of a score related to its displacement from an intended target aim-point. Alternatively, after a predetermined number of 'shots' have been fired, an enlarged representation of the target may be shown on the screen having marking in relation thereto the positional relationships of the aim points for each shot. The information resulting from the 'shot', whether or not displayed to the trainee on CRT display 11, may of course be shown on other displays visible to a tutor or other trainees.

Although there is still a bright flash associated with the temporary brightening of the marker region 29 it will be appreciated from FIG. 3 that this is small in comparison with the raster area and is in practice masked from the trainee by the weapon and is virtually unseen.

The above described method of detection point determination by means of detecting the line position of the mid point of the intersection of each raster line with the field of view is advantageous over determination of the centre of a field of view based upon any other criteria, such as detection of the edges of the field of view. Accuracy of determination is not affected by variations in field of view boundary positions, and corresponding changes in the length of the intersecting line section, such as may be occasioned by variations in CRT screen thickness, enlargement of the field of view by axial movement of the operating position and consequent uncertainty or softening of the boundary positions resulting from such movement.

The above described procedure for determining the detection point relies upon the determination of the time of occurrence of the of the peak of the single detection signal associated with the largest amplitude detection signal. It has been found in practice that with a field of view such as shown in FIG. 3 the rapid change of width either side of the centre enables the detection point to be determined with adequate accuracy by this method even though the information given by preceding detection signals is disregarded and lost in preference to that from a more suitable signal.

With a field of view of other shape, e.g. circular, there is less variation in line length permitting some uncertainty as to the identiy of the longest line.

If desired this otherwise discarded information may be employed to provide a more accurate determination of the detection point.

Referring to FIG. 4(*a*) this represents the marker region 29 of the raster showing a circular field of view boundary 39'. Considering now the succession of detection signals and particularly their times of occurrence in relation to the start of each line (line sync.) it may be found that the peaks occur at slightly different times on each line, as shown by the crosses 40 such that the single signal 40' associated with the largest (diameter) line and providing the line position of detection point may also be subject to small positional error. The locus of such points, shown by broken line 41, represents a bisector of the field of view in the field scan direction, that is, orthogonal to the line scan direction, and by its position with respect to the line scan origin, a more accurate representation of the line position of the detection point 34.

In the apparatus of the present invention the processing means 16 may be arranged to determine the occurrence time of each detection signal peak for all the lines intersecting the field of view and, by simple averaging or other correlation of them, provide a best estimate of the occurrence time (display element location) of the bisector and thus the detection point.

The procedure may be employed equally with the diamond shaped field of view described hereinbefore. It will be appreciated that with such a field shape, the bisector will be at an angle to the field direction but the average value will still correspond to the mid-point of the field of view.

The basic method of detection point determination operates on a line-by-line basis and provides the detection point to one raster line accuracy in the field direction.

Referring to FIG. 4(*b*) which illustrates graphically a succession of detection signals 42 which by their amplitudes indicate the lengths of the successive lines and by the peak signal occurrences the raster line centres 47. It will be seen from the Figure that if the detection point is coincident with a scanned line the detection signal amplitude associated with the line will be distinctly greater than those of adjacent lines, whereas if it is between lines there may be little difference in amplitude between successive detection signals.

Normally the detection point will be attributed to the line associated with the larger of the two signals but if electrical noise levels are sufficient an erroneous decision may be made associating the peak signal not with the closest raster line.

The positional accuracy in the field direction may be improved by correlating the peak values (amplitudes) of the succession of signals and determining from their amplitude envelope 44 the field position 45 giving the best estimate of the detection point to greater accuracy than an integral number of raster lines.

Considering again the relationship between sight-line and bore axes shown in FIG. 2 and detection and aim points in FIG. 3 it will be appreciated that the ability to determine the actual aim point with respect to the detection point depends upon the known displacement of the calibration procedure remaining unchanged. One source of change may be brought about by the weapon being held in an incorrect orientation about the bore axis, such that the detection and sightline axes are not in the same vertical plane as for the calibration procedure. It will be seen that such orientation displaces the aim and detection points horizontally and may result in a situation where the aim point is correctly designating the target but the detection point is displaced within the marker region 29. Furthermore all or part of the field of view of the detection means may fall outside of the marker region 29, and operation under these circumstances would indicate at best a lateral error in aim point and at worst a complete miss of the target area.

To avoid erroneous scoring of this sort it is desirable to provide orientation means for determining the orientation of the weapon about the bore axis or detection axis. At a simple level this may take the form of a pendulum, or other gravity controlled sensor, carried by the weapon and providing signals to the processing means 16 indicative of the degree of orientation or inhibiting operation of switching means 27 if the orientation is incorrect.

Preferably, however, such orientation means is incorporated with the photodetection means. Referring to FIG. 5(*a*) which shows a portion of photo-detection means housing 22' the photo-detection means 21' comprises a photodetector 46 which receives optical radiation by way of a lens 47 and an aperture 48 in a mask 49 defining the detection axis 23' and subtending the field of view 39' at the CRT screen containing detection point 34'.

The mask 49 has a further aperture 50 displaced vertically from that 48 so as to define a vertically displaced further detection axis 51 which defines a further field of view 52 at the CRT screen centred on a further detection point 53. An optical element, such as a prism 54 having reflective and semi-reflective faces, 55, 55' is loacted between the mask 49 and photodetector 46 to direct light received by way of apertures 48 and 50 onto the photodetector. The photo-detector produces an electrical output to signal amplifier 56 from which detection signals produced are split between two different processing channels on a time multiplexed basis depending on the relationship between the fields of view and the scanned raster by gating means 57 of the orientation means using known techniques. One channel carries the main detection signals for application to processing means 16 and the other channel further detection signals for application to orientation processing means 58 (FIG. 1). For example, if the fields of view are displaced in the field scan direction then the detectin signals received for one block of successive lines are applied to one processing channel and those for a subsequent block of lines to the other processing channel. FIG. 5(*b*) shows the relationship of such fields of view and detection points on the screen which will occur when the weapon is incorrectly orientated.

The control means 28 is arranged such that when the trigger is actuated and a signal is received from switching means 27 the predetermined area 29' of the raster representing a marker region large enough to include both fields of view is temporarily brightened.

Operation is similar to that described above in that the detection signals on each channel from the photodetection means 21' are applied to the processing means 16 and further processing means 58 and the positions of both the detection point 34' and further detection point 53 are determined in the line scan and field scan directions. If the field separation is F and the along-scan separation L then the orientation angle A of the weapon is readily calculated by the processing means from the relationship $\tan^{-1} L/F$.

This calculated angle A may be employed to modify the determined aim point unbeknown to the trainee by simply eliminating any apparent error which would not seriously affect the accuracy of a real shot over a long distance or may shown an orientation fault to be corrected. The degree of orientation error may be presented graphically or alphanumerically.

If it is desired only to draw attention to an orientation error without measuring it, say to alert the trainee or to discount the shot, the mere detection that the two detection points are displaced in the scan direction will be adequate, i.e. any finite value of L.

Irrespective of the complexity of processing undertaken, if the form of field of view boundary renders it advisable the along-scan position determination of both the detection point 35' and further detection point 53 may be achieved by determining the scan positions of the field of view bisectors using correlation of successive detection signals as described above.

It will be appreciated from FIG. 5(*a*) that the vertical separation F of the detection point 34' and further detection point 53 is also a function of the separation of the weapon from the screen. The value of F is determined during the calibration procedure with the weapon at the optimum or nominal operating position. Any subsequent changes in the value of F not accompanied by, or attributable to, changes in weapon orientation, can be used as a measure of any change in operating position distance from the screen.

Such a change may be determined reliably by the processing means using well known trigonometrical relationships between the value of F and the fixed angle between the detection axes 23' and 51.

A change in position may be employed to monitor the degree to which the field(s) of view become defocussed on the screen and warning may be given when the extend of movement-induced defocussing reaches a level at which determination of the detection point becomes unreliable.

It will be appreciated that there are many other variants on the above described arrangements. For instance it will be appreciated that the method of detecting the detection point outlined above has advantages over other methods known of detecting the point at which a photodetection means is directed with respect to a scanned raster. However, subject to their limitations, where the accuracy they offer is acceptable such forms of detection point determination may be employed.

As described above the peak value of each detection signal is found to occur a fixed time after the scanning spot has crossed the mid-point of intersection of that line with the field of view, irrespective of the length of line section and the peak value, or amplitude, of the detection signal represents the length of line section.

A correspondingly constant relationship also exists between the upward gradient of the pulse-like detection signal, the maximum gradient representing the line section length and the time of its occurrence a constant relationship with the time into the line scan (or line position) at which the line section mid-point occurs. The detection signals gradients may be employed instead of peak values to determine the detection point.

Considering other variations, the weapon, if a simulated one, may conveniently have the photodetection means contained with the barrel and the detection axis coaxial with the bore axis. If desired the photo-detection means may be contained in a separate housing which is mounted adjacent the muzzle of the barrel forming an extension thereof so that the axes are still common. This arrangement may be employed with a functional weapon as well as a simulated or modified one.

Alternatively, and again with either a simulatd, modified or functional weapon, the photo-detection means may be mounted alongside the barrel or other parts of the gun in other than the relationship shown herein. For convenience and simplicity the detection axis is aligned to extend parallel to the bore axis (to which the sight-line axis is aligned) and to oermit variation of the distance from the screen of the operating position after the simple calibration procedure outlined above. However, where orientation means of the type described using the photodetection means is employed the ability of the orientation means to measure the distance of the operating position from the screen also permits non-parallel disposition of the detection and sightline axes, the known displacement determined by the calibration procedure becoming a distance-dependant variable which, related to a known angle between detction and sightline axes, is varied in operation with measured changes in operating positions distance from the screen.

Such a non-parallel disposition of the detection and sight-line axes may result from making the sighting means adjustable in elevation in accordance with aiming at a target of the order of several hundred metres distant. The adjustment position of the sighting means is monitored (that is, inclination of sightline axis with respect to bore line axis) and the modified aim point determined with respect to the 'standard' aim point when the axes are in fixed relationship.

The 'known' displacement from the target image of the marker region 29 is a function of the relationship between sight-line and detection axis. Any change in their relative disposition is reflected in a change in marker region position. Preferably the displacement is kept relatively small permitting greater freedom in positioning the target image.

The aperture 37 described above has a diamond shape as shown in the Figures. This shape offers a distinct change in adjacent line lengths at all positions, particularly adjacent the centre, unlike the more conventional circular field also described above with reference to FIG. 4 wherein the lines in the vicinity of the diameter are very close in length to each other and may introduce uncertainty as to detection of the longest line section.

If desired, however, any field of view shape, including circular, may be employed.

Also, the relationship between aperture dimensions and lens-aperture separation is chosen to define the field of view of appropriate dimensions. Instead of a short separation and small aperture as shown, which results in a conveniently short housing for attachment to the weapon, a longer separation and corresponding larger aperture may be employed.

The orientation means described above includes photodetection means having a single photodetector for receiving radiation on detection axis and on the displaced further detection axis. If desired, the optical elements defining the further field of view may be replaced by a photodetector adjacent the aperture 50 such that the detection signals and further detection signals are initially produced on separate channels for ease of processing.

In order to improve the signal to noise ratio of detection the signals from both detectors may be considered to define an effective datum point as the centroid of the detection point and further detection point described above where the orientation means is not required to provide such distance measurement it may be configured with the detection and further detection axes parallel.

Although the above embodiment and its variants have been described with reference to a raster scanned horizontally, the raster may be generated by line scanning vertically or at any intermediate angle, the displacement relationships between aim point and detection point and between the detection point and further detection point of the orientation means being suitably referred to the origins of the raster used.

It will be appreciated that operation is not limited to the conventional raster in which a scanned area is defined by a field of parallel lines. A raster may also be formed by lines bearing other scanning relationships e.g. circular or radial in direction.

Furthermore it will be appreciated that each field may be defined other than by a raster, such as by a continuous spiral scan, the above described line numbers and line or along-scan positions being exchanged for continuous time interval measured from the scan origin. The marker region would however still be defined and appear as a raster of successively generated line sections of the spiral.

It will also be appreciated that the screen on which the target image and marker region are dispayed may be other than a directly viewed CRT device, for instance a projection television or equivalent mechanically scanned projector.

Alternative forms of displays which comprise a matrix of addressable illuminable pixel points, such as the so called plasma-display panels, may be employed provided that the relevant pixels associated with the marker region can be selectively and sequentially illuminated to enable the photo-detection means to provide detection signals having suitable characteristics for determination of line length and centre for each 'line' intersecting the field of view.

Furthermore the display may be a combination of optically projected target image displaced from a portion of the screen on which a marker region is produced by optical scanning a spot or formed by a CRT or other electronic display of relatively small display area. Depending upon the type of display apparatus employed to form the marker region, the succession of display element locations scanned may maintain their illumnination afterwards such that the light level in the field increases linearly with each line scanned and with intervals between successive increasing portions. The detection technique then employed would determine the increasing function of longest duration, or greatest slope in any line period to determine the line of the detection point and the centre of the increasing functions to determine the positions of the detection point.

The optical radiation emitted by definition of the marker region and receiving by the photodetection means is referred to herein generally as 'light'. It will be understood that such radiation need not be in the visible part of the spectrum.

As stated above the simulated weapon may be completely artificial or a real weapon modified to provide the trainee with tuition and practise without the firing of projectiles.

The rifle conveniently is a standard rifle modified such that when the trigger is actuated a recoil effect is simulated. This may be achieved by a fluid operated piston and cylinder assembly carried within the rifle body and transmitting an impulse to a shoulder contacting plate in the butt. The fluid is conveniently gaseous such as compressed air provided by compressor 59 (FIG. 1) under the control of controller. In response to the trigger signal the controller provides a recoil signal to delay means 60 which delays it for an interval sufficient for the raster to define the marker region before applying it to the compressor 59. The air is supplied along flelxible pipe lines 61 which are conveniently ganged with the control and detection signal cables. The lines and cables are conveniently coupled to the underside of the barrel so as not to be directly visible to the trainee in the shooting position, nor to interfere with handling of the weapon.

In order to monitor that the trainee is utilising the weapon correctly, in other respects as well as aiming, those parts of the weapon which are manipulated in a firing operation may be sensed as to their operation and the sequence of such operation monitored. For example, emptying the firing chamber requires pulling on a lever with a predetermined minimum force for its full travel distance and then releasing it to travel back under spring action. Suitable sensors can be located on the gun mechanism to ensure that each task is perfomred and from their signals returned to the processing means it can monitor that each sequence is carried out correctly. Similarly, to ensure that the trigger is actuated by a continuous squeezing motion rather than a jerking motion, the switching means 27 may be arranged to monitor the motion of the trigger.

Finally it will be appreciated that the projectile firing weapon may be other than a gun, for example a crossbow, whih has suitable sighting means to define a sight-line and a projectile ejection axis corresponding to the gun bore axis.

I claim:

1. Weapon optical aim-training apparatus for a projectile firing type of weapon, said apparatus comprising (i) display means, including a screen, arranged to display an image of a target, (ii) a weapon means arranged to be directed at the screen and displaced therefrom at an operating position, said weapon including (a) sighting means defining a sight-line axis which extends to, and intersects, the screen to define an aim point, (b) photo-detection means having a field of view centred on a detection axis which extends to, and intersects, the screen at a detection point such that the detection point is displaced from the aim point in a known relationship, and (c) switching means operatively connected to a trigger of the weapon, (iii) control means responsive to operation of the switching means by actuation of the trigger to cause said display means to define on the screen, by the emission of optical radiation from a plurality of display element locations as a raster of lines of successively illuminated display element locations, a marker region smaller than the screen, but larger than the field of view of the photo-detection means, and displaced from the target image by said known relationship, and (iv) processing means responsive to the detection by the photo-detection means of optical radiation from said marker region of the screen to determine the position of the detection point with respect to the raster and thus the position of the aim point with respect to the position of the target image.

2. Apparatus as claimed in claim 1 in which said display means further includes means to display the target image by continuously scanning the screen in a raster of lines producing a spot of light modulated in intensity.

3. Apparatus as claimed in claim 2 wherein said display means further includes means to produce a raster of lines producing the target image and the marker region.

4. Apparatus as claimed in claim 1 in which the display means comprises a cathode ray tube on the screen of which the marker region is defined.

5. Apparatus as claimed in claim 1 in which said weapon means comprises a firearm having a barrel and said photo-detection means is aligned with respect to the barrel such that the detection axis is at least parallel to the barrel bore axis.

6. Apparatus as claimed in claim 5 in which the photo-detection means is located in relation to the weapon such that the detection axis and bore axis are coaxial.

7. Apparatus as claimed in claim 6 in which said weapon means is a functional weapon, said photodetection means being located in an extension housing adapted to be releasably mounted adjacent the muzzle of the barrel.

8. Apparatus as claimed in claim 6 in which said sighting means is aligned with respect to the bore axis such that the sightline and bore axes extend substantially parallel to each other and displaced such that when the weapon is held correctly the sightline and bore axes both extend in a vertical plane through the weapon.

9. Apparatus as claimed in claim 1 wherein said detection means further includes means wherein the field of view at the detection point extends for a plurality of raster lines.

10. Apparatus as claimed in claim 1 in which said display means is arranged to produce the raster of said marker region with respect to a datum point of the marker region by the illumination of display element locations on one line only at a time, said photodetection means being responsive to the successive illumination of display element in each line of the marker region extending through the field of view to generate a detection signal, the duration and amplitude of which is related to the length of the line section intersecting the field of view, and said processing means including peak detection means operable to determine the occurrence of the peak of each detection signal as a function of a predetermined positional relationship between the mid-point of the line section intersecting the field of view and the marker region on that line and calculating means responsive to a succession of detection signals representing the raster lines of said marker portion intersecting the field of view and to raster control signals to determine the raster line associated with the detection signal having the largest amplitude and the mid point of the line section intersecting the field of view to define the detection point with respect to the datum point.

11. Apparatus as claimed in claim 10 in which the photodetection means comprises a photodetector responsive to changes in the level of optical radiation received thereby to produce an electrical output having a level representative thereof and a signal amplifier having a response rise time not less than the maximum time in any scanned line of the marker region that optical radiation can be received by the photodetector to which said photodetector electrical output is applied to produce the detection signal.

12. Apparatus as claimed in claim 10 in which the calculating means includes correlation means operable to determine from the locus of the calculated mid point positions of said successive detection signal peaks the bisector of the field of view and determine from the position of said bisector an estimate of the position of the detection point on its associated raster line.

13. Apparatus as claimed in claim 1 including orientation means operable to determine the orientation of the weapon about the bore axis.

14. Apparatus as claimed in claim 13 in which the orientation means comprises photo-detection means arranged to define a further field of view centred on a further detection axis extending to, and intersecting the screen at, a further detection point within said marker region when the weapon is held in the correct orientation about the bore axis and orientation processing means responsive to detection by the photo-detection means of optical radiation from the marker region within said further field of view to determine the position of the further detection point with respect to the raster and from its relationship with the position of the detection point determine the orientation of said weapon about the bore axis.

15. Apparatus as claimed in claim 14 in which the photodetection means includes means to define both the field of view and a further field of view and is responsive to optical radiation therefrom to provide detection signals and said orientation means further includes signal gating means responsive to raster control signals to direct said detection signals to the processing means or orientation processing means in accordance with the part of the marker region from which they are detected.

16. Apparatus as claimed in claim 14 further includes means whereby said further detection point is displaced from the detection point by a predetermined number of raster lines and to occupy substantially the same position along the respective line when the weapon is held in the correct orientation.

17. Apparatus as claimed in claim 14 in which the orientation processing means further includes means responsive to a positional displacement in line scan direction between the detection point and the further detection point to indicate incorrect orientation.

18. Apparatus as claimed in claim 17 in which the orientation processing means further includes means responsive to the magnitude of position displacement in the line direction and the number of lines of separation between the detection and further detection points to determine the value of orientation error.

19. Apparatus as claimed in claim 17 in which the display means further includes means to produce the raster of said marker region with respect to a datum point of the marker region by the illumination of display element locations on one line only at a time, said photodetection means further including means responsive to the successive illumination of display element in each line of the marker region extending through the field of view to generate a detection signal, the duration and amplitude of which is related to the length of the line section intersecting the field of view, and said processing means including peak detection means that determines the occurrence of the peak of each detection signal as a function of a predetermined positional relationship between the mid-point of the line section intersecting the field of view and the marker region on that line and calculating means including means responsive to a succession of detection signals representing the raster lines of said marker portion intersecting the field of view and to raster control signals to determine the raster line associated with the detection signal having the largest amplitude and the mid point of the line section intersecting the field of view to define the detection point with respect to the datum point, in which the calculating means includes correlation means to determine from the locus of the calculated mid point positions of said successive detection signal peaks the bisector of the field of view and determine from the position of said bisector an estimate of the position of the detection point on its associated raster line, in which the angle between the detection and further detection axes is fixed and the orientation processing means includes means to determine from said angle and the displacement of detection and further detection points on the screen the distance from the screen of the weapon operating position.

20. Apparatus as claimed in claim 1 in which the switching means includes means to monitor passage of the trigger through a plurality of intermediate positions during its actuation, the processing means including monitor means to determine from the times of passage of the trigger through said intermediate positions correct actuation of the trigger.

21. Apparatus as claimed in claim 1 in which said means weapon further includes recoil simulating means responsive to a recoil signal from the control means to cause delivery of a pulse of compressed fluid to a cylinder carried by the weapon, said cylinder containing a piston displaceable by the fluid to transmit a mechanical impulse to the weapon, said control means including delay means to delay said recoil signal for an interval sufficient for said marker region to be defined on the screen for the photo-detection means.

* * * * *